US009175433B2

(12) United States Patent
Park et al.

(10) Patent No.: US 9,175,433 B2
(45) Date of Patent: Nov. 3, 2015

(54) CONTROL METHOD OF LAUNDRY TREATMENT APPARATUS

(75) Inventors: Hye Yong Park, Changwon-si (KR); Yang Hwan Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 13/513,817

(22) PCT Filed: Dec. 14, 2010

(86) PCT No.: PCT/KR2010/008932

§ 371 (c)(1),
(2), (4) Date: Jun. 4, 2012

(87) PCT Pub. No.: WO2011/074854

PCT Pub. Date: Jun. 23, 2011

(65) Prior Publication Data

US 2012/0240427 A1 Sep. 27, 2012

(30) Foreign Application Priority Data

Dec. 15, 2009 (KR) ..... 10-2009-0124667

(51) Int. Cl.
*F26B 7/00* (2006.01)
*D06F 58/12* (2006.01)
*D06F 73/02* (2006.01)

(52) U.S. Cl.
CPC ..... *D06F 58/12* (2013.01); *D06F 73/02* (2013.01)

(58) Field of Classification Search
CPC . D06F 58/12; D06F 73/02; D06F 2058/2851; D06F 2058/2896; F26B 7/00
USPC ..... 34/381, 401, 262, 380, 390, 425, 423, 34/426, 394, 427, 395; 38/85
See application file for complete search history.

(56) References Cited

U.S. PATENT DOCUMENTS

| | | | | |
|---|---|---|---|---|
| 3,644,085 | A | 2/1972 | Beeley et al. | |
| 3,739,496 | A * | 6/1973 | Buckley et al. | 34/210 |
| 4,196,526 | A * | 4/1980 | Berti | 34/77 |
| 4,621,438 | A * | 11/1986 | Lanciaux | 34/77 |
| 6,925,737 | B2 * | 8/2005 | Bolduan et al. | 38/1 A |
| 2003/0223309 | A1 * | 12/2003 | Hapke | 366/342 |
| 2008/0148596 | A1 | 6/2008 | Son et al. | |
| 2009/0126423 | A1 | 5/2009 | Bae et al. | |
| 2009/0241268 | A1 * | 10/2009 | Yoo et al. | 8/149.3 |
| 2009/0241269 | A1 | 10/2009 | Yoo et al. | |
| 2009/0260254 | A1 * | 10/2009 | Moon et al. | 34/427 |
| 2010/0115785 | A1 * | 5/2010 | Ben-Shmuel et al. | 34/260 |

FOREIGN PATENT DOCUMENTS

| | | | |
|---|---|---|---|
| CN | 1037557 | A | 11/1989 |
| CN | 1773002 | A | 5/2006 |
| CN | 101210375 | A | 7/2008 |
| EP | 1 939 349 | A2 | 7/2008 |
| EP | 2 107 158 | A1 | 10/2009 |
| JP | 2006-130157 | A | 5/2006 |
| JP | 2006130157 | A * | 5/2006 |
| KR | 10-2007-0092891 | A | 9/2007 |
| WO | WO 2008/075899 | A1 | 6/2008 |

* cited by examiner

*Primary Examiner* — Kenneth Rinehart
*Assistant Examiner* — John McCormack
(74) *Attorney, Agent, or Firm* — Dentons US LLP

(57) ABSTRACT

A control method of a laundry treatment apparatus (100) is disclosed. A control method of a laundry treatment apparatus (100) configured to supply steam and/or heated air to an accommodating space (12) accommodating laundry therein, the control method includes a water supplying step supplying water to water supplying device (130) configured to supply steam, a step supplying steam to the accommodating space (12) by heating of water inside the water supplying device (130), the step applying a horizontal motion to the laundry for a predetermined time period, simultaneously with the steam supplying, a cooling step cooling the laundry, and a drying step supplying heated air having a predetermined temperature to the accommodating space (12).

13 Claims, 6 Drawing Sheets

CONTROL METHOD OF LAUNDRY TREATMENT APPARATUS

This application is a National Stage Entry of International Application No. PCT/KR2010/008932, filed Dec. 14, 2010, and claims the benefit of Korean Application No. 10-2009-0124667, filed on Dec. 15, 2009, each of which is hereby incorporated by reference for all purposes as if fully set forth herein.

TECHNICAL FIELD

The present invention relates to a control method configured to supply moisture, mist and steam to clothes to perform sanitization for clothes.

BACKGROUND ART

In recent, various kinds of laundry treatment apparatuses are used together with washing machines used to wash laundry items including clothes, cloth items, beddings and the like. For example, there have been developed a variety of laundry treatment apparatuses including drum type dryers capable of drying laundry items having being washed, cabinet type dryers capable of drying laundry items hung thereon, and refreshers capable of refreshing laundry items by using hot air supplied to the laundry items.

However, such a cabinet type laundry treatment apparatus has a variety of disadvantages.

DISCLOSURE OF INVENTION

Technical Problem

Accordingly, the present invention is directed to a control method of a laundry treatment apparatus.

An object of the present invention is to provide a control method of a laundry treatment apparatus, which can perform sanitization by supplying of water, mist, steam and the like to laundry.

Solution to Problem

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a control method of a laundry treatment apparatus configured to supply steam and/or heated air to an accommodating space accommodating laundry therein, the control method includes a water supplying/heating step supplying water to a water supplying device configured to supply steam and heating the water; a re-supplying step re-supplying water to the water supplying device; a steam supplying step heating the water inside the water supplying device and supplying steam to the accommodating space, with the laundry kept still; a cooling step cooling the accommodating space; and a drying step supplying heated air having a predetermined temperature to the accommodating space.

Advantageous Effects of Invention

According to the control method of the laundry treatment apparatus of the present invention, water, mist, steam and the like are supplied to laundry. As a result, sanitization for the laundry may be performed.

It is to be understood that both the foregoing general description and the following detailed description of the present invention are exemplary and explanatory and are intended to provide further explanation of the invention as claimed.

BRIEF DESCRIPTION OF DRAWINGS

The accompanying drawings, which are included to provide a further understanding of the disclosure and are incorporated in and constitute a part of this application, illustrate embodiment(s) of the disclosure and together with the description serve to explain the principle of the disclosure.

In the drawings.

BEST MODE FOR CARRYING OUT THE INVENTION

Reference will now be made in detail to the specific embodiments of the present invention, examples of which are illustrated in the accompanying drawings. Wherever possible, the same reference numbers will be used throughout the drawings to refer to the same or like parts.

This specification embodies a refresher configured to refresh clothes, with being capable of supplying heated air, as laundry treatment apparatus and the present invention is not limited thereto. A subject matter of the present invention may be applicable to any devices having a heat pump which will be described later. Here, 'refresh' means a process of performing wrinkle removal, deodorization, static electricity prevention and laundry warming and the like by supplying air, heated air, water, mist and steam to clothes, cloth items and the like (hereinafter, referenced to as 'laundry'). the term 'laundry' includes clothes, apparel, shoes, socks, gloves, hats and mufflers which are wearable by people and dolls, towels and beddings which useable. That is, 'laundry' includes all kinds of objects of which washing may be performed.

Figure 1:
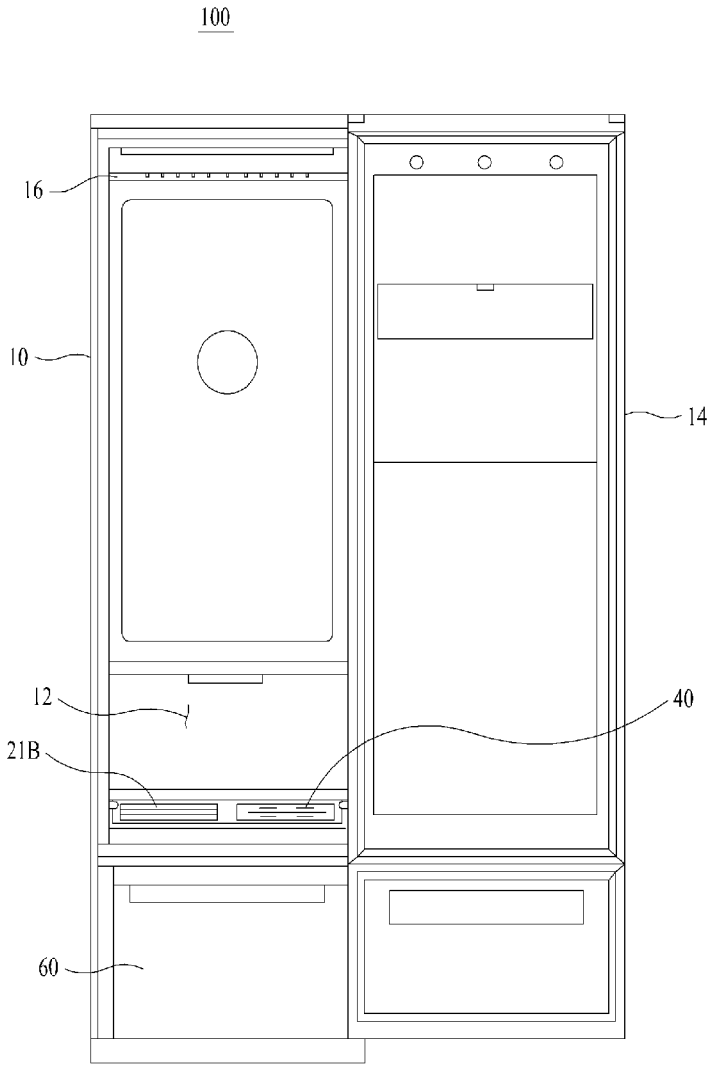
FIG. 1 is a front view illustrating a door 14 provided in a laundry treatment apparatus, in an open state.

In reference to FIG. 1, a laundry treatment apparatus 100 includes a cabinet 10 having a predetermined accommodating space 12 formed therein to accommodate laundry, an air supplying device (22, see FIG. 2) configured to supply air or heated air to the accommodating space 12, a water supplying device (30, see FIG. 2) configured to spray water, mist or steam to the accommodating space 12 selectively, and a control part (not shown) configured to control the air supplying device 22 and the water supplying device 30.

A variety of components, which will be described later, are provided in the cabinet 10 and the accommodating space 12 is formed in the cabinet 10 to accommodate laundry therein.

The accommodating space 12 is selectively in communication with an outside by a door 14. Various supporters 16 may be provided in the accommodating space 12 to hang clothes thereon. The supporters 16 are configured to stand still or to maintain a fixed state to keep the clothes motionless. Here, the supporters may be configured to apply predetermined movement to the clothes when air, heated air, water, mist or steam is supplied to the clothes, which will be described later. In reference to FIGS. 2 and 3, this configuration will be described as follows.

Figure 2:
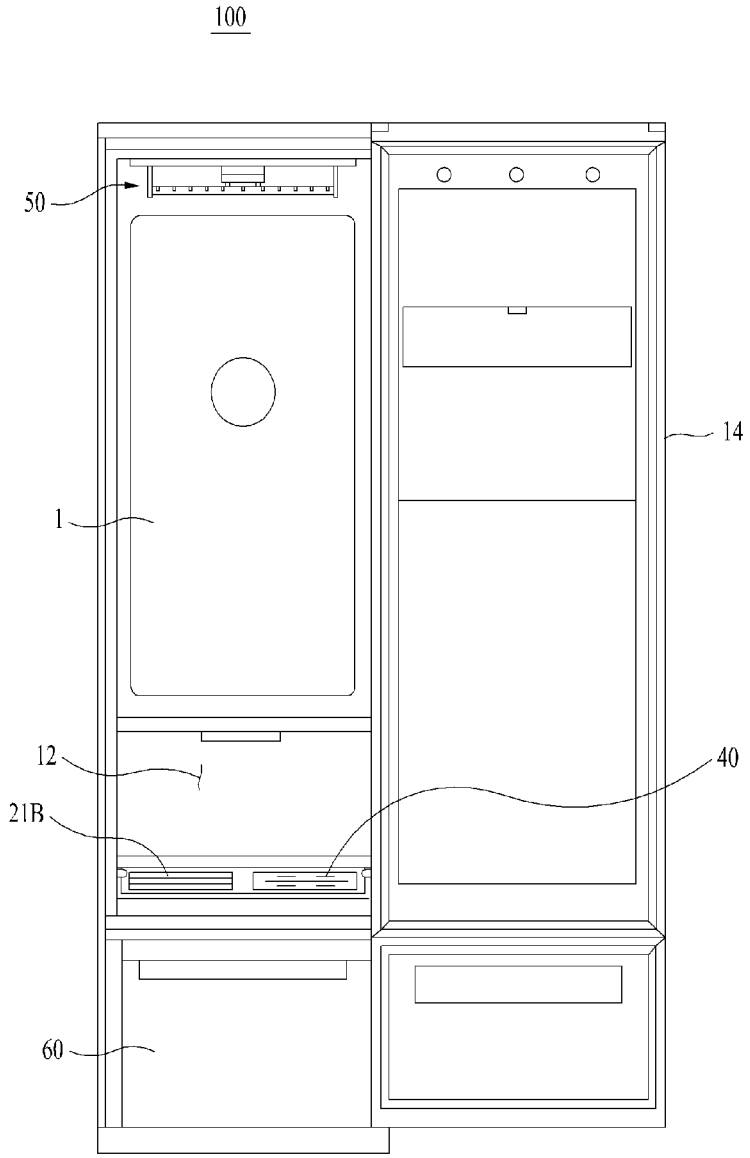
FIG. 2 is a front view illustrating a laundry treatment apparatus according to another embodiment of the present invention.

FIG. 2 is a front view illustrating a laundry treatment apparatus according to another embodiment of the present invention. Compared with the above embodiment, the laundry treatment apparatus according to this embodiment includes a moving hanger configured to apply a predetermined motion to clothes hung thereon. As follows, this difference will be described in detail.

In reference to FIG. 2, laundry is hung on a moving hanger 50 provided in the accommodating space 12 and the moving hanger 50 is configured to apply a predetermined motion to the laundry hung thereon. If the predetermined motion is applied to the laundry supplied air, heated air, water, mist or steam, the effect of laundry refreshing may be enhanced.

Figure 3:
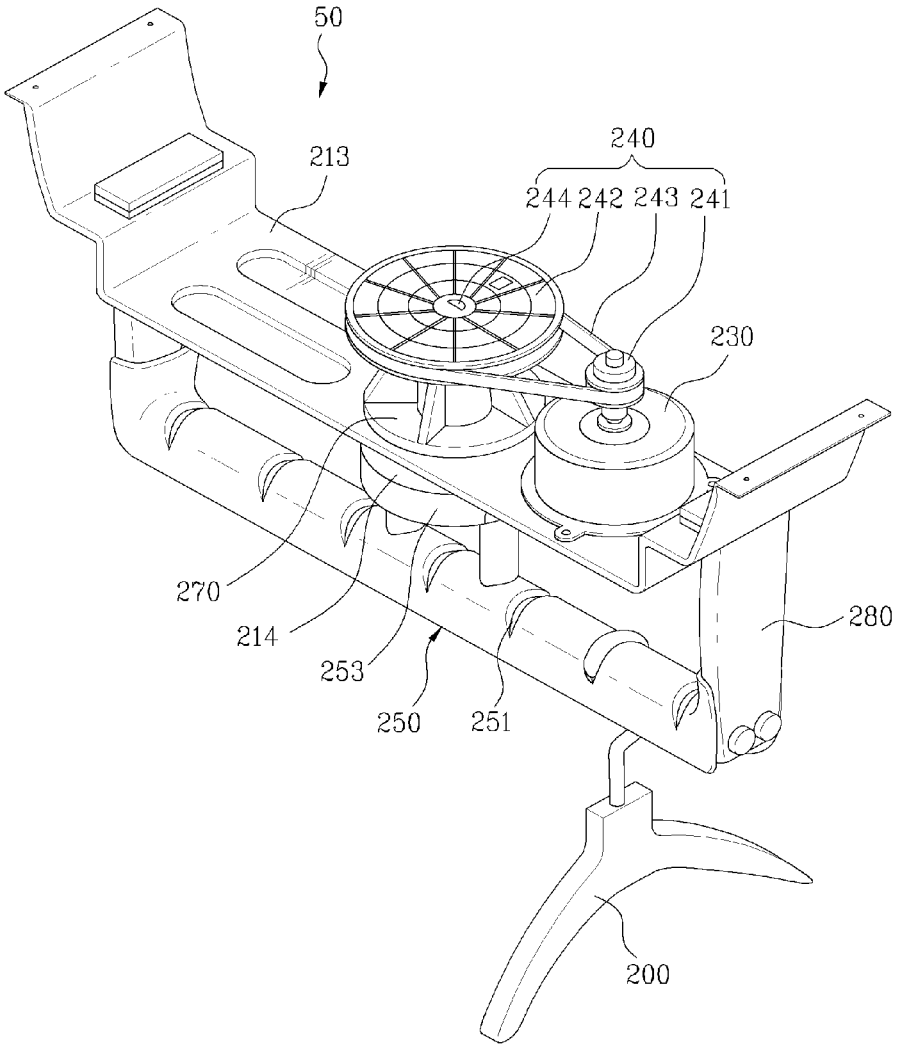
FIG. 3 is a perspective view illustrating a moving hanger shown in FIG. 2.
Figure 4:
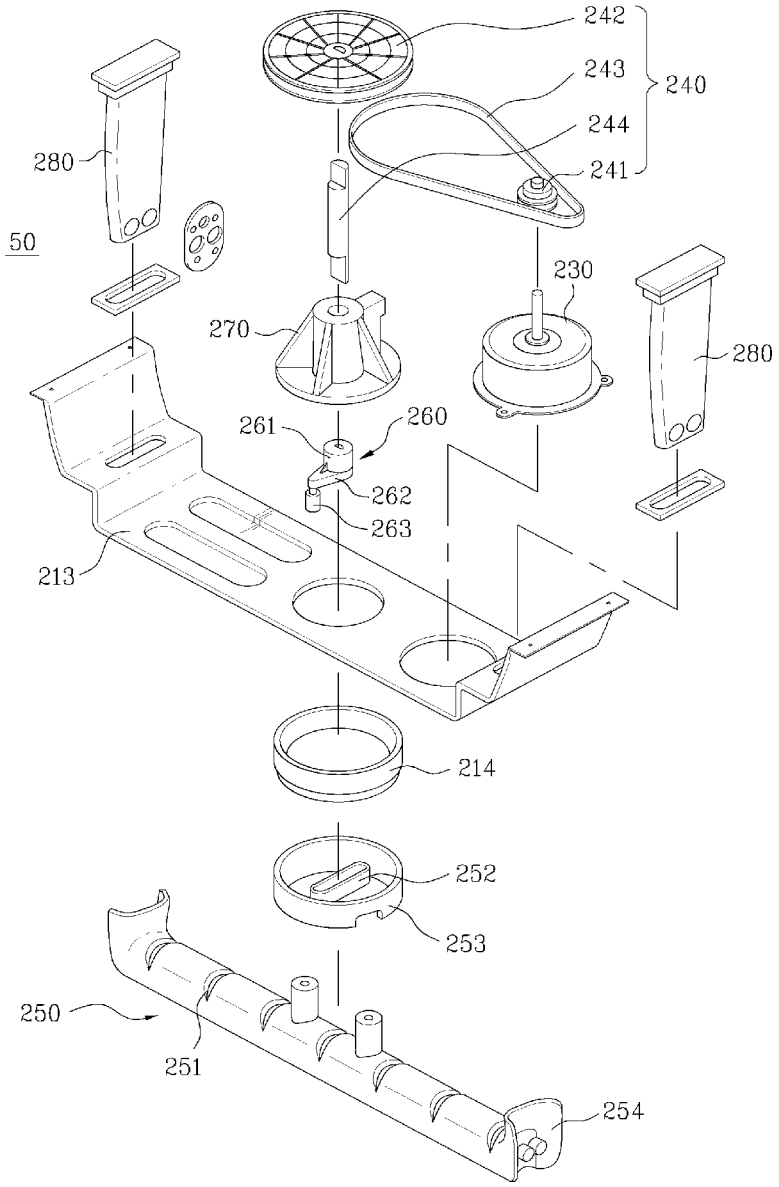
FIG. 4 is an exploded perspective view of FIG. 3.

FIG. 3 is a perspective view illustrating the moving hanger 50 and FIG. 4 is an exploded perspective view illustrating the moving hanger 50.

In reference to FIGS. 3 and 4, the moving hanger 50 includes a hanger bar 250 configured to support laundry hung on a hanger 200 and a supporting part 280 configured to support both ends of the hanger bar 250. A plurality of hanger recesses 251 may be provided in the hanger bar 250 to fix the location of the hanger 200 hung on the hanger bar 250. The supporting part 280 is connected to a moving hanger frame 213 and the moving hanger frame 213 is provided beyond a ceiling of the cabinet 10, not to be seen outside. Both ends of the hanger bar 250 include supporting part ribs 254, respectively, and the supporting rib 254 is covering the end of the supporting part 280.

As a result, the clothes received in the laundry treatment apparatus according to the present invention are hung on at least one hanger. Because of that, not only an improved refreshing effect but also improved drying efficiency for the clothes may be expected, compared with the conventional laundry treatment apparatus.

In the meanwhile, the moving hanger 50 includes a motor 230, a power converting part 260 configured to convert a rotational force provided by the motor 230 into a horizontally linear motion of the hanger bar 250, and a power transmitting part 240 configured to transmit the power generated from the motor 230 to the power transmitting part 260.

The power transmitting part 240 includes a driving pulley 241 provided in the motor 230, a driven pulley 242 connected to the driving pulley 241 by a belt 243, and a shaft 244 coupled to a center of the driving pulley 242. The shaft 244 may be rotatably provided in a bearing housing 270 provided in the moving hanger frame 213.

The hanger bar 250 may further include a slot 252 which lies at right angles to its longitudinal direction. Specifically, a slot housing 253 is provided on the hanger bar 250 and the slot 252 is located approximately in a center of the slot housing 252. The power converting part 260 may include a slot inserting portion 263 inserted in the slot 252, a shaft connecting portion 261 connected to the shaft 244 and a rotation arm 262 connecting the slot inserting portion 263 and the shaft connecting portion 261 with each other. The power converting part 260 is covered by a cover 214 not to be seen outside and the cover 214 is provided between the moving hanger frame 213 and the slot housing 253.

Under this configuration, when the motor 230 is rotated, the driving pulley 242 is rotated and the shaft 244 coupled to the driving pulley 242 is rotated. At this time, the slot inserting portion 263 will perform a circular motion, with a predetermined diameter.

Here, the slot 252 provided in the hanger bar 250 may be orthogonal to the longitudinal direction of the hanger bar 250. By extension, the length of the slot 252 is larger than a rotational locus of the slot connecting portion 263. Because of that, the slot 252 may perform a linear motion along a horizontal direction even when the slot inserting portion 263 performs a circular motion.

In the meanwhile, a mechanism chamber 20 configured to accommodate the air supplying device 22 and the water supplying device 30 may be provided in the cabinet 10. The mechanism chamber 20 may be located below the accommodating space 12 and it includes the air supplying device 22 and the water supplying device 30 received therein. The reason why the mechanism chamber 20 is located below the accommodating space 12 is that the heated air or steam supplied to the accommodating space 12 has a property of ascending and that the mechanism chamber 20 is located below the accommodating space 12 to supply the heated air or steam upwardly.

Figure 5:
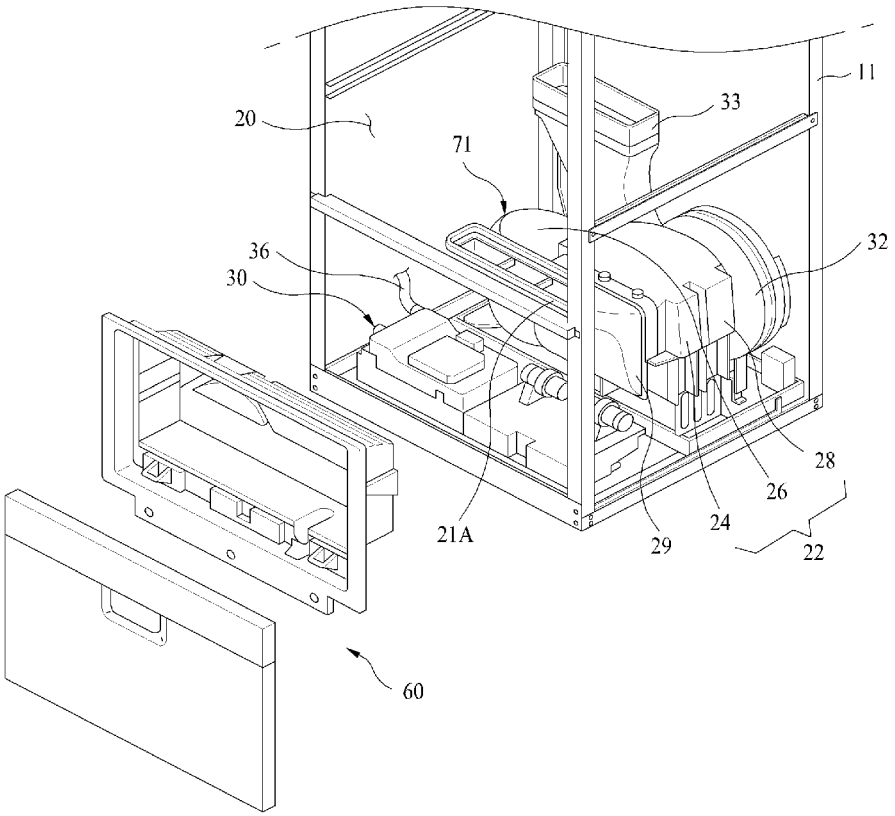
FIG. 5 is a schematic diagram illustrating an inner configuration of a mechanism chamber.

FIG. 5 is a perspective view schematically illustrating an inner configuration of the mechanism chamber 20. To illustrate the inner configuration of the mechanism chamber 20, only a frame 11 of the cabinet 10 is shown in FIG. 5 for convenience sake. In addition, only main components including the air supplying device 22 and the water supplying device 30 are illustrated in FIG. 5 for convenience sake and a drainage line connecting those components with each other is not illustrated.

In reference to FIG. 5, the air supplying device 22 configured to supply air or heated air to the accommodating space 12 may be located within the mechanism chamber 20.

A heat pump 22 embodied as the air supplying device according to the present invention may include an evaporator 24, a compressor 26, a condenser 28 and an expansion valve (not shown) which allow refrigerant to flow there through. Because of that, air is dehumidified and heated.

In other words, latent heat of ambient air is absorbed, while refrigerant is evaporated in the evaporator 24. After that, air is cooled and moisture contained in the air is condensed and eliminated. When refrigerant is condensed in the condenser 28 after passing the compressor 26, latent heat is exhausted toward ambient air. After that, the ambient air may be heated. As a result, the evaporator and the condenser 28 are functioned as heat exchanger. The air sucked into the mechanism chamber 20 may be dehumidified and heated while passing the evaporator 24 and the condenser 28, to be supplied to the accommodating space 12.

The air heated by the heat pump 22 has a relatively lower temperature than the air heated by a conventional electric heater. However, the air heated by the heat pump 22 may be dehumidified without using any auxiliary dehumidifying device. As a result, the air re-supplied to the accommodating space 12 by the heat pump 22 may be corresponding to 'relatively low dry air' (here, the term of 'low temperature' means not an absolutely low temperature but a relatively lower temperature than the temperature of conventional heated air). The laundry treatment apparatus according to the embodiment of the present invention may supply low temperature dry air to the laundry. Because of that, the laundry treatment apparatus according to the embodiment of the present invention may prevent deformity or damage which might be generated by the high temperature of heated air used in performing refreshing or drying for the laundry. That is, the air supplied by the heat pump 22 in the laundry treatment apparatus according to the embodiment of the present invention may have the lower temperature than the hot air supplied in the conventional laundry treatment apparatus but it may be dehumidified without any auxiliary dehumidifying device, to dry and refresh the laundry efficiently and smoothly.

Specifically, an air inlet (21A, see FIG. 5) is formed in a front portion of a top of the mechanism chamber 20 suck air of the accommodating space 12 into the mechanism chamber 20. An air path of the air may be formed by an inlet duct 29 configured to connect the air inlet 21A, the evaporator 24, the condenser 28 and the fan 32 with each other. The air drawn into the mechanism chamber 20 via the air inlet 21A by the inlet duct 29 may be dehumidified and heated while passing the heat pump 22. The dehumidified and heated air may be re-supplied to the accommodating space 12 via an outlet duct 33 and an air outlet 21B by a fan 32.

Here, although not shown in the drawings, a filter may be provided in the air inlet 21A. The filter provided in the air inlet 21A may filter various foreign substances contained in the air drawn into the mechanism chamber 20 from the accommodating space 12 and only fresh air can be re-supplied to the accommodating space 12.

Furthermore, the water supplying device 30 may be provided in the mechanism chamber 20 to supply water, mist or steam (hereinafter, referenced to as 'steam') to the accommodating space 12 selectively.

The water supplying device 30 includes a heater (not shown) configured to heat water and the water is heated to generate steam. The water supplying device 30 supplies the generated steam to the accommodating space 12. An external water tap may be used as water supply source supplying water to the water supplying device 30 or a water supplying tank (not shown) may be provided in a predetermined portion of the mechanism chamber 20 as water supply source.

The water supplying tank may be provided in a door module 60 detachably installed in a predetermined portion of the mechanism chamber 20. Because of that, a user may separate the water supplying tank from the mechanism chamber 20 for water refill and he or she may re-install the tank.

Also, the steam generated in the water supplying device 30 is supplied to the accommodating space 12 via a steam hose 36 and a steam nozzle (40, see FIGS. 1 and 2). In this case, it is more preferable, as the shorter the steam hose 36 is, to prevent the temperature of the steam from being lowered or condensed while the steam moving through the steam hose 36. When the mechanism chamber 20 is located below the accommodating space 12, the steam nozzle 40 may supply steam via a top of the mechanism chamber 20 which is a bottom of the accommodating space 12.

A circulating fan (not shown) may be provided in a rear portion of the mechanism chamber 20 and the circulating fan supplies external air to the mechanism chamber 20. Because of that, the internal air of the mechanism chamber 20 may be prevented from increasing too much when the heat pump 22 and the water supplying device 30 are put into operation.

As follows, a control method of a laundry treatment apparatus having the above configuration will be described.

Figure 6:
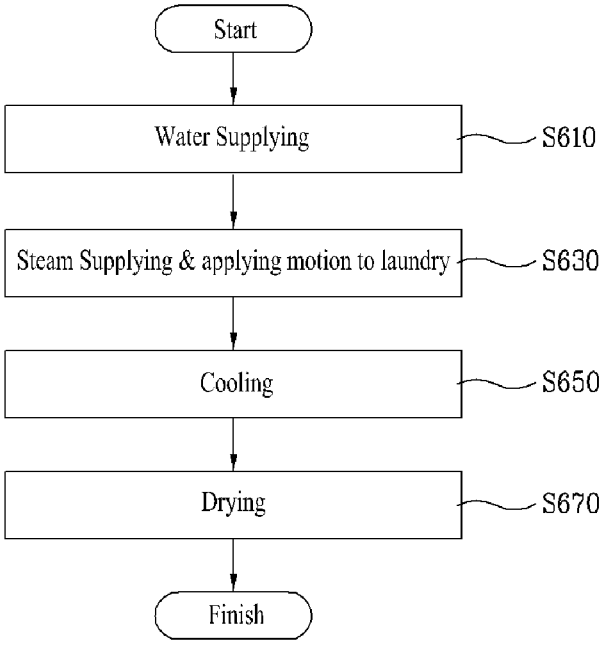
FIG. 6 is a flow chart illustrating a control method according to an embodiment of the present invention.

FIG. 6 is a flow chart illustrating a control method according to an embodiment of the present invention.

In reference to FIG. 6, a control method according to an embodiment of the present invention includes a water supplying step (S610) supplying water to the water supplying device which supplies team, a steam supplying/laundry moving step (S630) supplying steam to the accommodating space by heating the water inside the water supplying device and applying a horizontal motion to the laundry for a predetermined time period, a cooling step (S650) cooling the laundry and a drying step (S670) drying heated air having a predetermined temperature to the accommodating space. The control method according to this embodiment may perform wrinkle removal, deodorizing, static electricity prevention for the laundry by supplying of steam, air, heated air and the like to the laundry.

First of all, the control part supplies water to the water supplying device 30 (S610). In this case, the control part controls the water to be supplied to a full-water level of the water supplying device. For that, a water level sensor may be provided in the water supplying device to detect a water level. The control part controls the water to be supplied to the water supplying device until the water level sensor detects that the water reaches the full-water level.

Here, the control part may further include heating the water until the temperature of the water reaches a predetermined temperature in the water supplying step. This step is configured to reduce the time required to heat the water to generate steam in a steam generating step which will be described later. The water may be heated at the moment when the water is supplied or in a predetermined time after the water is supplied. A heater and the like may be provided in the water supplying device to heat the water.

Hence, the control part heats the water inside the water supplying device and it supplies steam to the accommodating space, simultaneously with applying a predetermined horizontal motion to the laundry (S630). The control part uses the heater provided in the water supplying device to heat the water and it supplies steam to the accommodating space. In the meanwhile, simultaneously with supplying steam to the accommodating space, the control part drives the moving hanger 50 to apply the horizontal motion to the laundry. Especially, the control part drives the moving hanger 50 to apply a horizontal motion to the laundry with a preset RPM, for example, a horizontally linear motion, a horizontally closed curve motion and a horizontally reciprocating motion. The motion is applied to the laundry, simultaneously together with supplying the steam to the laundry. Compared with the laundry kept still without any motion, the laundry having the predetermined motion applied thereto may contact with more steam and the effects of wrinkle removal, deodorization and static electricity prevention may be remarkably improved. The steam supplying time may be adjustable properly according to the kind of the laundry, the kind of fabric, a property of fabric. The steam supplying time determined according to the kind of the laundry may be stored in the control part in advance. The laundry moving time may be continued or periodically repeated for the steam supplying time.

After supplying steam, the control part controls unheated air to be supplied to the laundry for a predetermined time period to perform laundry cooling (S650). Only the fan 32 is operated, not the heat pump 22, and unheated air is supplied to the accommodating space 12 to perform the cooling. Because of that, it is possible to lower the internal temperature of the accommodated space 12 heated by the steam supplied thereto and the temperature of the laundry.

Hence, the control part controls air heated or dried by the heat pump 22 to the accommodating space 12, to dry the laundry. When drying the laundry, the control part controls the heat pump 22 to supply the heated air having a temperature of 45° C. to 60° C., preferably, 50° C. to 55° C. The laundry containing relatively much moisture because of the steam supplying may be dried by the heated air supplied thereto, to be pleasantly wearable. The control part may further include a step of applying a predetermined motion to the laundry in the drying step according to the control method of this embodiment. In other words, the control part may apply a predetermined motion to the laundry when supplying the heated air to the accommodating space 12. Specifically, the control part drives the moving hanger 50 to apply the predetermined motion to the laundry. The motion is applied to the laundry, simultaneously together with supplying the heated air and the laundry having the predetermined motion applied thereto may contact with more heated air and drying efficiency may be remarkably improved. The step applying the predetermined motion to the laundry may be performed by driving of the moving hanger 50 and this is similar to the laundry motion performed in the steam supplying step described above and repeated description thereof will be omitted accordingly.

Figure 7:
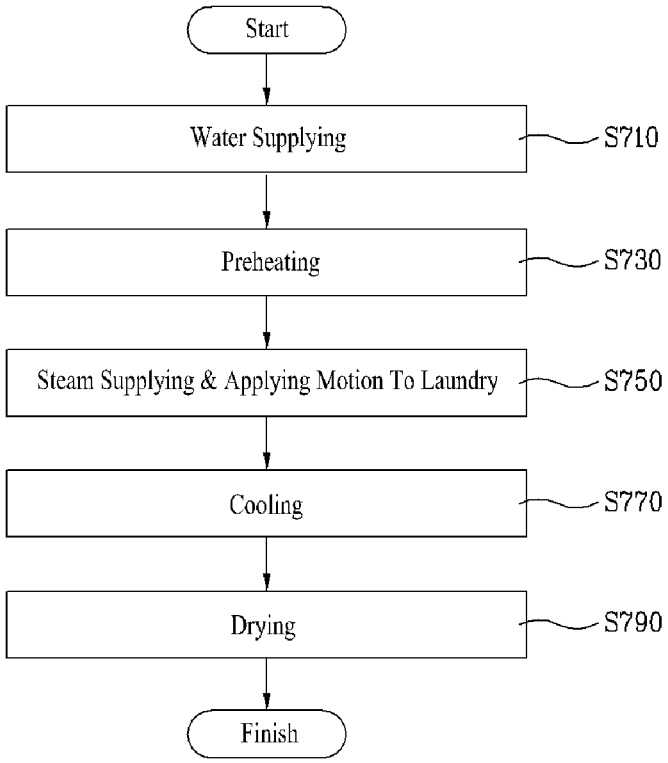
FIG. 7 is a flow chart illustrating a control method according to another embodiment of the present invention.

FIG. 7 is a flow chart illustrating a control method according to another embodiment of the present invention. Compared with the above embodiment, the control method according to this embodiment of FIG. 7 includes a preheating step preheating the accommodating space before the steam supplying/laundry moving step (S750). As follows, this difference will be described in detail.

The control method according to this embodiment includes the preheating step (S730). The preheating step (S730) supplies heated air to the accommodating space 12 to have a predetermined temperature, before steam is supplied to the accommodating space by using the water supplied to the water supplying device. If the temperature of the accommodating space 12 is too low when the steam is supplied to the accommodating space 12, the effects of wrinkle removal, deodorization and static electricity prevention might deteriorate. Because of that, the control part controls the temperature of the accommodating space 12 to increase up to a predetermined temperature, for example, 15° C. to 25° C., before supplying steam. In this case, the control part drives the heat pump 22 to supply heated air to the accommodating space 12 and then it increases the temperature of the accommodating space 12.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

INDUSTRIAL APPLICABILITY

According to the control method having the above configuration and steps enables the laundry to be sanitized by using water, mist, steam and the like.

The invention claimed is:

1. A control method of a laundry treatment apparatus configured to supply steam and/or air to an accommodating space accommodating laundry therein, the control method comprising:

a water supplying step supplying water to a moisture generating device configured to supply steam;

a steam supplying step supplying steam to the accommodating space by heating of water inside the moisture generating device, the steam supplying step applying a horizontal motion to the laundry for a predetermined time period, simultaneously with the supplying steam;

a cooling step cooling the laundry; and a drying step supplying heated air having a predetermined temperature to the accommodating space using a heat pump, wherein the cooling step is operated after the steam supplying step and prior to the drying step, wherein the cooling step supplies unheated air to the accommodating space by using a fan, not the heat pump, for a predetermined time period to lower an internal temperature of the accommodated space and the predetermined temperature of the heated air in the drying step.

2. The control method of claim 1, wherein a predetermined motion is applied to the laundry in the drying step.

3. The control method of claim 1, wherein the water supplying step includes a heating step heating the water inside the moisture generating device to a predetermined temperature.

4. The control method of claim 1, wherein the step applying the motion to the laundry moves the laundry linearly in a horizontal direction.

5. The control method of claim 1, wherein the water supplying step supplies the water to a full-water level of the moisture generating device.

6. A control method of a laundry treatment apparatus configured to supply steam and/or air to an accommodating space accommodating laundry therein, the control method comprising:

a water supplying step supplying water to a moisture generating device configured to supply steam;

a preheating step supplying heated air having a predetermined temperature to the accommodating space, the preheating step performed after the water supplying step;

a steam supplying step supplying steam to the accommodating space by heating of water inside the moisture generating device, the steam supplying step applying a horizontal motion to the laundry for a predetermined time period, simultaneously with the supplying steam;

a cooling step cooling the laundry; and a drying step supplying heated air having a predetermined temperature to the accommodating space, wherein the cooling step is operated after the steam supplying step and prior to the drying step, wherein the preheating step and the drying step supply heated air by using a heat pump, wherein the cooling step supplies unheated air to the accommodating space by using a fan, not the heat pump, for a predetermined time period to lower an internal temperature of the accommodated space and the predetermined temperature of the heated air in the drying step.

7. The control method of claim 1, wherein a predetermined motion is applied to the laundry in the drying step.

8. The control method of claim 1, wherein the water supplying step includes a heating step heating the water inside the moisture generating device to a predetermined temperature.

9. The control method of claim 1, wherein the preheating step supplies the heated air to the accommodating space until the temperature of the accommodating space reaches 15° C. to 25° C.

10. The control method of claim 1, wherein the step applying the motion to the laundry moves the laundry linearly in a horizontal direction.

11. The control method of claim 1, wherein the horizontal motion to the laundry moves the laundry along a locus of a closed curve in a horizontal direction.

12. The control method of claim 1, wherein the horizontal motion to the laundry reciprocates the laundry at a predetermined RPM.

13. The control method of claim 1, wherein the drying step supplies heated air having a predetermined temperature of 45° C. to 60° C.

* * * * *